US012636536B1

(12) United States Patent
Norris

(10) Patent No.: US 12,636,536 B1
(45) Date of Patent: May 26, 2026

(54) EXERCISE STATION FOR MOBILITY IMPAIRED USERS

(71) Applicant: Thomas T Norris, Valencia, PA (US)

(72) Inventor: Thomas T Norris, Valencia, PA (US)

( * ) Notice: Subject to any disclaimer, the term of this patent is extended or adjusted under 35 U.S.C. 154(b) by 0 days.

(21) Appl. No.: 19/308,582

(22) Filed: Aug. 25, 2025

Related U.S. Application Data

(60) Provisional application No. 63/690,052, filed on Sep. 3, 2024.

(51) Int. Cl.
*A63B 21/055* (2006.01)
*A63B 21/00* (2006.01)

(52) U.S. Cl.
CPC ..... *A63B 21/0557* (2013.01); *A63B 21/4029* (2015.10); *A63B 2225/10* (2013.01)

(58) Field of Classification Search
CPC ..... A63B 21/0557; A63B 21/4029; A63B 2225/10; A61H 3/008; A61H 3/04; A61H 2003/007; A61H 2201/0192; A61H 2201/1652
See application file for complete search history.

(56) References Cited

U.S. PATENT DOCUMENTS 3,384,332 A * 5/1968 Fenner ..... A63B 7/00 248/165
3,778,052 A * 12/1973 Andow ..... A61H 3/04 482/67
5,013,035 A * 5/1991 Nathaniel ..... A63B 23/03533 482/129
5,261,682 A * 11/1993 Chuang ..... B62B 5/04 280/42
5,662,560 A * 9/1997 Svendsen ..... A63B 71/0009 482/54
5,667,461 A * 9/1997 Hall ..... A63B 69/0064 482/54
6,148,580 A * 11/2000 Weir ..... A62B 35/0062 182/36
6,165,085 A * 12/2000 Lubin ..... A63B 63/004 273/400
(Continued)

FOREIGN PATENT DOCUMENTS

KR 10065132 B1 5/2005

OTHER PUBLICATIONS

Screenshot of www.workoutandrecovery.com of exercise assembly shown used with beds and chairs based on Salamon patent.
(Continued)

*Primary Examiner* — Garrett K Atkinson
(74) *Attorney, Agent, or Firm* — Karen Tang-Wai Sutton

(57) ABSTRACT

An exercise station for mobility impaired users disposed as a frame assembly comprising various PVC pipes pressure fitted into PVC fittings to form a rectangular frame assembly with a front and back frames attached by side struts and a top, the frame assembly removably affixed to a base, a top side of the base and a space created below the top side and the sides of the frame assembly defining a seated exercise space adapted to receive a chair, wheelchair, walker or bench seat. The exercise station is adapted to removably receive one or more resistance bands and accessories. The exercise station and its accessories are available as one or more kits, with the frame assembly ideally having a weight of no more than 70 pounds and each pipe weighs no more than 1.6 pounds.

12 Claims, 6 Drawing Sheets

(56) References Cited

U.S. PATENT DOCUMENTS

| | | | | |
|---|---|---|---|---|
| 6,280,361 | B1 * | 8/2001 | Harvey | A63B 24/00 482/4 |
| 6,368,260 | B1 | 4/2002 | Crews | |
| 7,568,715 | B2 * | 8/2009 | Cooney | A63B 19/02 280/205 |
| 7,618,355 | B1 * | 11/2009 | Murdock | A63B 21/153 482/121 |
| 7,621,860 | B2 | 11/2009 | Burrell | |
| 7,625,320 | B2 * | 12/2009 | Wehrell | A63B 21/4007 482/130 |
| 7,666,126 | B2 * | 2/2010 | Rempe | A63B 26/003 482/121 |
| 7,887,471 | B2 * | 2/2011 | McSorley | A63B 21/0552 482/136 |
| 9,393,455 | B2 * | 7/2016 | Salamon | A63B 21/0442 |
| 9,452,102 | B2 * | 9/2016 | Ledea | A61H 3/04 |
| 9,700,751 | B2 * | 7/2017 | Verdi | A63B 21/4017 |
| 9,884,221 | B2 | 2/2018 | McJames, II | |
| 10,398,619 | B2 * | 9/2019 | Crombie | A63B 21/068 |
| 10,639,510 | B2 * | 5/2020 | Agrawal | A61H 1/001 |
| 10,744,362 | B2 | 8/2020 | Goldish | |
| 11,690,534 | B2 * | 7/2023 | Nakashima | A61B 5/1038 600/595 |
| 11,712,391 | B2 * | 8/2023 | Otsuki | A61H 1/0262 482/4 |
| 11,878,197 | B2 * | 1/2024 | Henniger | A63B 21/0628 |
| 11,883,347 | B2 * | 1/2024 | Buswell | A61G 7/1065 |
| 12,161,902 | B1 * | 12/2024 | Whiteley | A63B 23/1218 |
| 12,208,308 | B2 | 1/2025 | Guerra | |
| 12,280,289 | B2 | 4/2025 | Lewis-Dove | |
| 2003/0141692 | A1 * | 7/2003 | Perena | A61H 3/008 280/250.1 |
| 2009/0163336 | A1 | 6/2009 | Mueller | |
| 2012/0197168 | A1 * | 8/2012 | Agrawal | A63B 21/4009 602/19 |
| 2016/0038370 | A1 * | 2/2016 | Dreske | A61H 3/04 482/68 |
| 2018/0369053 | A1 * | 12/2018 | Lukashevich | A63B 24/0003 |
| 2020/0114195 | A1 * | 4/2020 | Henniger | A63B 21/0628 |
| 2020/0353340 | A1 * | 11/2020 | Arredondo | A63B 69/215 |
| 2025/0001239 | A1 * | 1/2025 | Hoover | A63B 21/4029 |

OTHER PUBLICATIONS

Paper flyer advertising assembly shown used with a wheelchair based on Salamon patent and previously disclosed in provisional application filing.

* cited by examiner

EXERCISE STATION FOR MOBILITY IMPAIRED USERS

CROSS-REFERENCE TO RELATED APPLICATIONS

This application claims benefit of provisional U.S. patent application Ser. No. 63/690,052 filed on 3 Sep. 2024, from which priority and benefit is claimed under all applicable sections of Title 35 of the United States Code including, but not limited to, Sections 120, 121, and 365(c), and which in its entirety is incorporated by reference into this application.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The invention pertains to the field of exercise equipment, specifically, an exercise station designed specifically for mobility-impaired individuals with limited leg use who require daily or persistent use of wheelchairs or walkers and provided in a lightweight kit with pressure fitted parts easy to assemble and disassemble with minimal fasteners and tools.

Background Art

The medical field strongly believes that circulation of the blood that carries oxygen to the body is enhanced through regular exercise, and that exercise helps the heart pump blood through the body. While exercise is important for good health, people with mobility impairment, such as those who are wheelchair-bound or require the use of walkers, find it difficult to use currently existing equipment as designed. Most exercise equipment, whether it is designed for home use or professional equipment in a gym, require a high level of ambulation and dexterity.

Mobility impaired adults benefit from home-based full body exercise systems, as they remove barriers to regular exercise, including embarrassment of exercising in a public space, cost of a gym membership, and the hassle of arranging transportation. Unfortunately, existing full body home-based exercise systems are often unaffordable, bulky and difficult to move around or install. In particular, mobility impaired elderly adults have a particular need for weight training exercises as they overwhelmingly suffer from sarcopenia due to a lack of use of their muscles. While many exercises can be adapted to sitting individuals, the equipment itself is poorly adapted for sitters who are not otherwise able to move around easily. For instance, hand held dumbbells can be used while sitting, but the individual must pick them up off the floor or other adjacent surfaces. Given the range of motion required for various exercises, a nearby table or stool to hold the weights before or after use is often inadequate and clumsy to use. Further, a table or stool next to a chair or wheelchair does not allow for the weights to be in a convenient "use" position and thus can lead to wasted time. The restrictive nature of a wheelchair or walker can also create access problems with existing equipment, where tight spaces may limit mobility for a person using a wheelchair or walker. Weighted equipment can also pose hazards for those with limited mobility.

What is needed is a home exercise station specially adapted for non or limited ambulatory individuals using wheelchairs and walkers, and whose design organizes the exercise equipment in a way that is easily accessible, affordable, safe to use, convenient, lightweight but sturdy construction, and provides a wide range of exercises for strengthening the entire body.

DISCLOSURE OF INVENTION

An exercise station adapted for seated use by a mobility impaired person using a cane, wheelchair or walker and adapted for use with a plurality of resistance bands removably attached thereto, the exercise station comprising an upper frame assembly assembled using a plurality of PVC pipes, such as Schedule 40 pipe having at least a 1 inch diameter, each pipe of the plurality of pipes having a predetermined length and pipe diameter, and a plurality of pipe fittings, the fittings further include T-shaped, Y-shaped, cross shaped and elbow shaped fittings, adapted to receive the pipes. Each pipe fitting having a predetermined configuration and fitting diameter adapted to be pressure fitted into the pipes so as to form a rectangular-shaped cage having a front frame, a back frame, a top side, a left side, a right side and an exercise space between the left side and the right side and below the top side. Horizontal struts join the front and back frames together and are adapted to support an accessory bench. The frame assembly is adapted to be assembled and disassembled using minimal tools. The top side of the frame assembly has at least two horizontal pipes in parallel, spaced apart relationship. A base removably coupled to the frame assembly by at least two vertical couplers is sized and shaped so as to cover at least an entire area below the top of the frame assembly with at least one chamfered edge. The base may be a single unit or comprised of two or more parts. The vertical couplers may be L-shaped brackets or straps permanently or removably affixed to either the frame assembly or to the base. A band anchor is fixed to the base and adapted to receive a resistance band, and the frame assembly is adapted to have resistance bands, benches, grab bars and other accessories removably attached thereto. The accessories, along with the frame assembly and the base may be provided as one or more kits for assembly. The pipes and fittings of the frame assembly together weigh no more than 70 pounds.

BRIEF DESCRIPTION OF THE DRAWINGS

The features and advantages of the invention will become apparent from a consideration of the subsequent detailed description presented in connection with accompanying drawings in which.

DRAWINGS LIST OF REFERENCE NUMERALS

Figure 1:
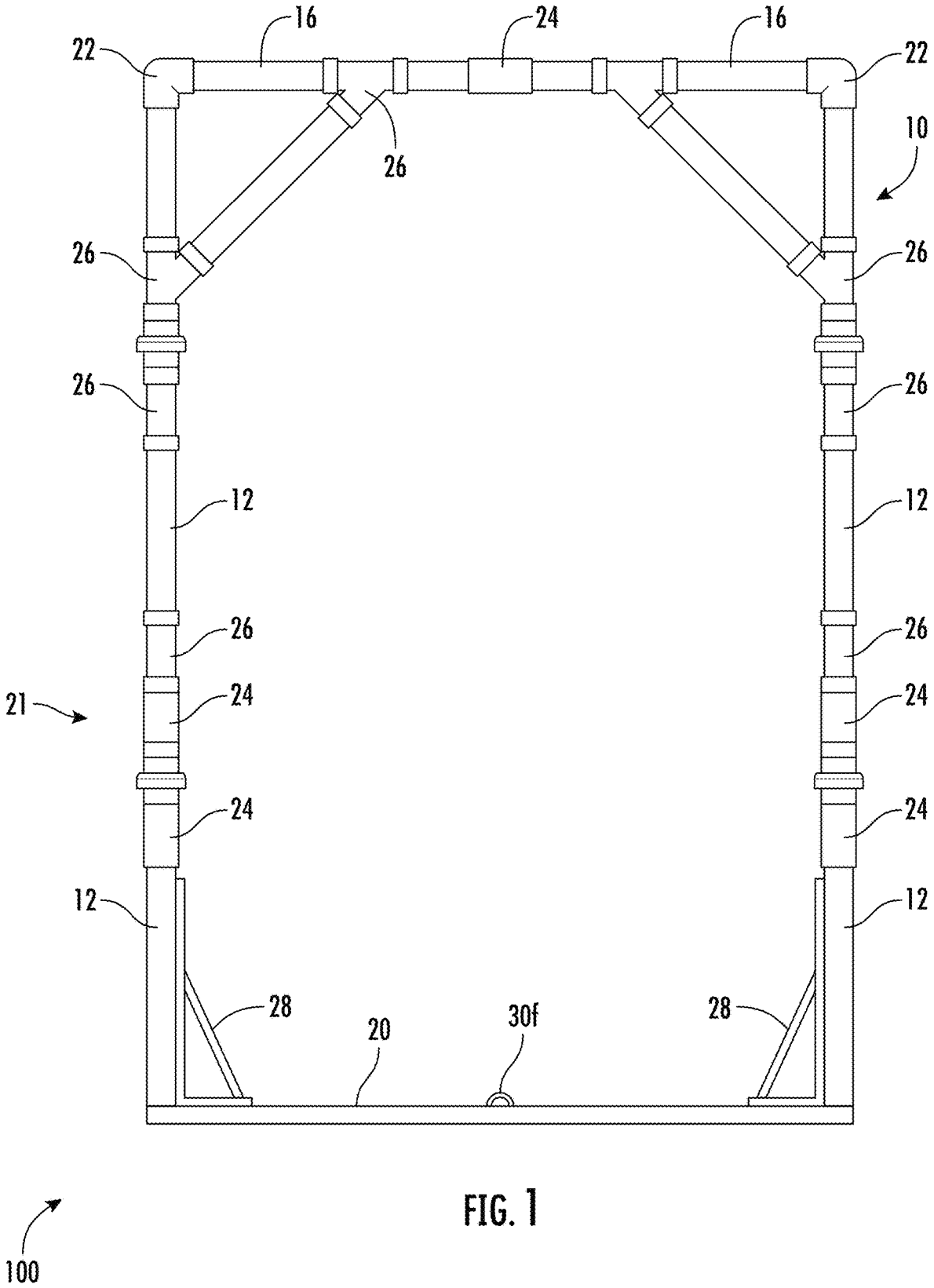
FIG. 1 is a front elevation view of an exercise station according to the invention, showing an upper frame assembly coupled to a base.
Figure 2:
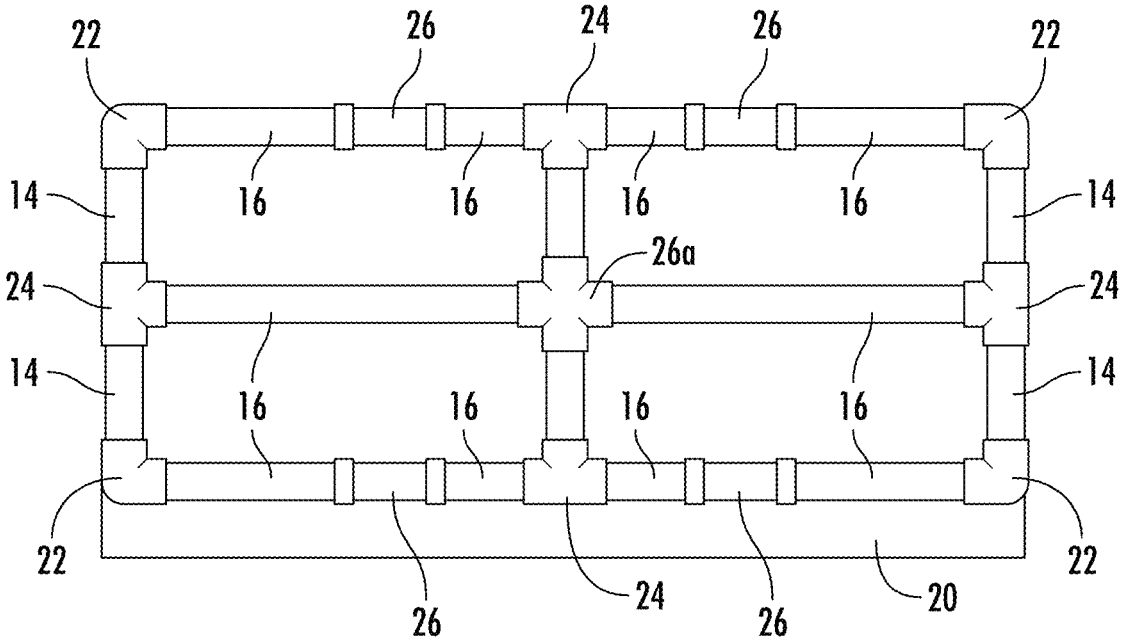
FIG. 2 is a top view of the exercise station in FIG. 1.
Figure 3:
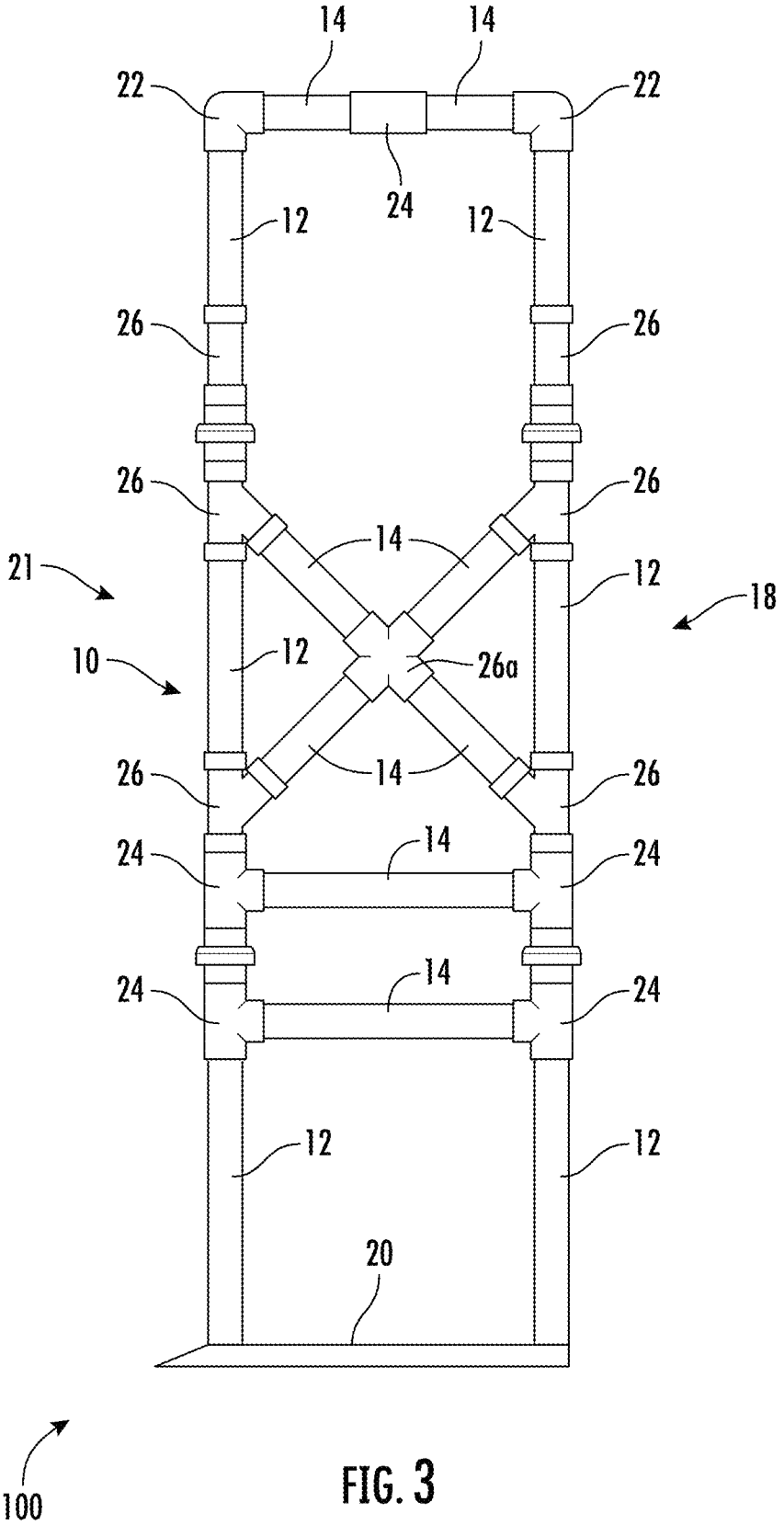
FIG. 3 is a right side view of the exercise station in FIGS. 1 and 2.

The following is a list of reference labels used in the drawings to label components of different embodiments of the invention, and the names of the indicated components:

100 exercise station
10 front frame
12 vertical element
14 strut
16 horizontal element
18 back frame
20 base
21 frame assembly
22 elbow receiver fitting
24 tee or T receiver fitting
26 wye or Y receiver fitting
26*a* cross receiver fitting
28 vertical coupler
28*a* fastener
30 exercise accessories
30*a* bar accessory
30*b* hand grip accessory
30*c* resistance band
30*d* bench
30*dd* bench leg
30*ddd* bench back rest
30*da* bench coupler
30*e* cup holder
30*f* band anchor (attached to base)
32 grab bar
34 wheelchair
36 walker
38 strap

DETAILED DESCRIPTION

Figure 4:
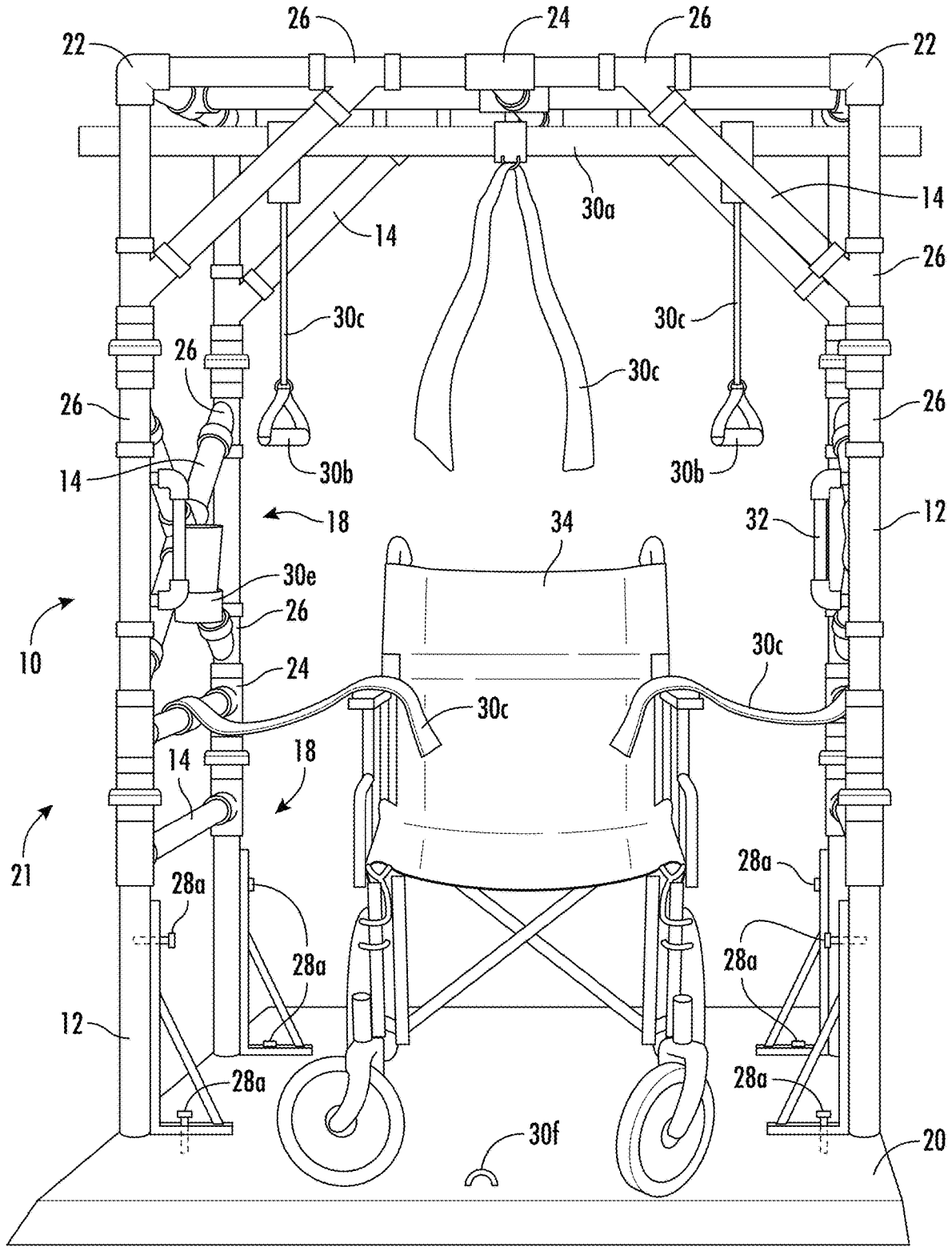
FIG. 4 is a front perspective view of the exercise station according to the invention, shown with a wheelchair in a use position on the base and with a variety of exercise accessories installed on the frame assembly demonstrating how the exercise station can be used for resistance training of a user sitting in the wheelchair.
Figure 5:
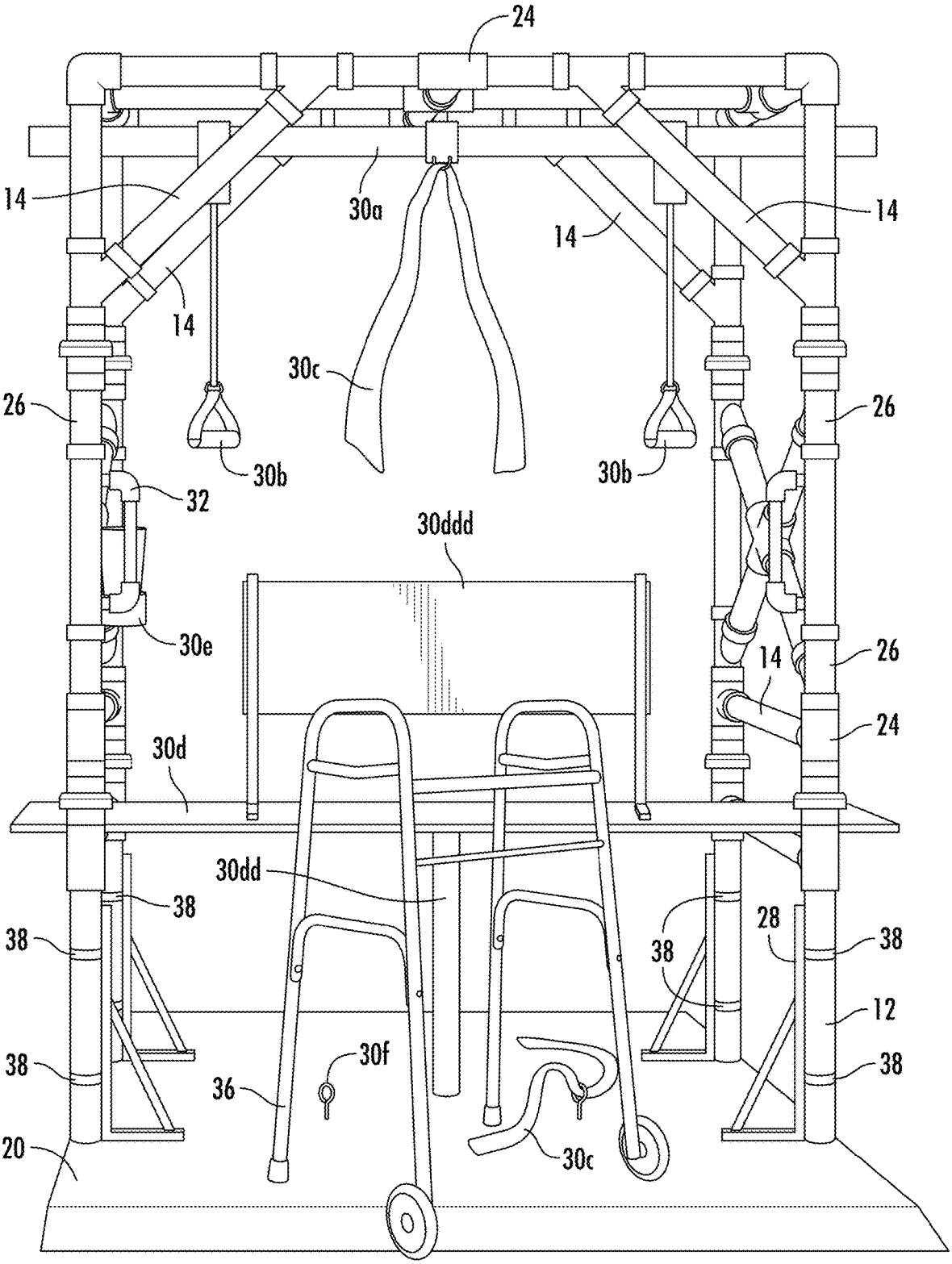
FIG. 5 is a second front perspective view of the exercise station according to the invention, shown with a walker and outfitted with an accessory bench and a variety of resistance band accessories attached to the frame assembly and to the base.
Figure 6:
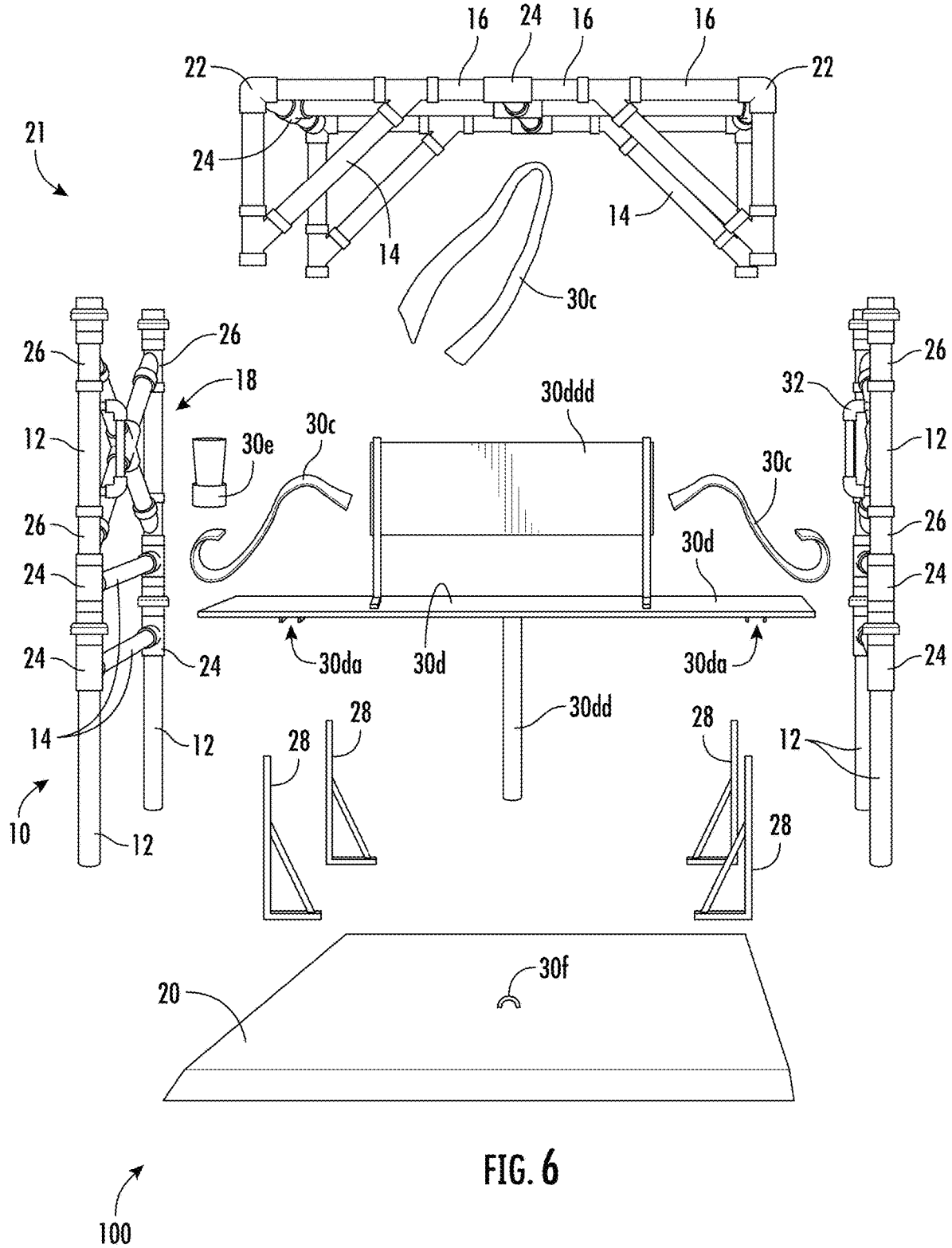
FIG. 6 is a partial exploded view of the exercise station according to the invention, shown with some accessories adapted to be attached to the frame assembly of the exercise station.

An exercise station according to the invention or exercise station 100 designed for use by mobility impaired users relying on wheelchairs, walkers, canes and other mobility assistant devices is shown in the accompanying FIGS. 1-6, showing the exercise station 100 in a representative embodiment as it would be used with a wheelchair 34 in FIG. 4 and a walker 36 in FIG. 5. A chair (not shown) can also be used in lieu of the wheelchair 34 inside the exercise station 100, or for users relying on a cane or a walker without a seat, an accessory bench 30*d* as part of a kit, can be used in lieu of a separate seat or chair. The FIGS. additionally show the representative embodiment outfitted with some examples of suitable accessories 30 for use with the exercise station 100. The accessories 30 include bars 30*a*, hand grips 30*b*, elastic resistance bands 30*c*, the bench 30*d*, and a cup holder 30*e* are all for attachment to the exercise station 100. One or more floor anchors 30*f* installed on a base 20 of the exercise station 100 provide a variety of different leg exercise options for a seated user.

Turning to the FIGS., the exercise station 100 is comprised of a frame assembly 21 having a front frame 10 and a back frame 18, with a plurality of elbow 22, tee or T 24, wye or Y 26, and cross shaped or cross receiver 26*a* fittings into which a plurality of struts 14, vertical elements 12 and horizontal elements 16 are pressure fitted as shown in the FIGS. to form the rectangular frame assembly 21 accessible from a front side and a back side of the frame assembly 21. The struts 14 join the back frame 18 to the front frame 10. All fittings 22 24 26 26*a*, horizontal and vertical elements 12 16, and struts 14 are made of PVC, preferably Schedule 40 pipe or other similar structural plastic pipe for strength, affordability and weight. It is an object of this invention that the exercise station 100 is capable of being disassembled and reassembled with minimal tools and thus pressure fittings are ideal for this purpose. Also, PVC pipe is used because it is inexpensive and lightweight relative to the heavy metal exercise cages of the prior art. It is another object of this invention that the exercise station 100 is lightweight relative to its size for ease of shipping, movement, assembly, etc. while being strong enough to allow the user to apply downward forces on the frame assembly 21 using resistance bands 30*c* and body weight. It should be noted that even the frailest user can still weigh at 100 pounds or more, and thus the frame assembly 21 must be able to withstand acute forces at various points along the frame assembly 21, including from the vertical sides, at locations where the resistance bands 30*c* are attached and thus apply directed force concentrated at that specific location.

The base 20 is a rigid and inflexible piece of material, ideally wood, metal or structural plastic with a thickness and rigidity that does not bend or otherwise deform when a user's weight is distributed to the four legs or wheels of the wheelchair or other seat positioned on and supported by the base 20 when the user is in a use position underneath the top of the frame assembly 21. In the FIGS., the base 20 shown is slightly deeper than the frame assembly 21 when measured front to back, and a same width as the frame assembly 21, however the base 20 is minimally a same width and depth as the frame assembly 21 and can be larger in any dimension, as desired. The base 20 is a critical stability component of the exercise station 100. The frame assembly 21 is attached to the base 20 by a vertical coupler 28, in the representative embodiment shown as a foldable L-shaped bracket 28 attached to the vertical elements 12 by one or more straps 38 or in an alternative embodiment using fasteners such as bolts or pins 28*a*, and many other known coupling systems that require minimal to no tools or separate parts can also be used so long as they can securely but removably attach the frame assembly 21 to the base 20. It is an object of this invention that the exercise station 100 be capable of being assembled and disassembled with minimal tools and small parts that may be difficult to grasp by an older user, or that are easily lost, as well as repeatably assemble and disassembled without damage to its parts.

The folding L-brackets 28 shown in the representative embodiment can also be permanently attached to the vertical elements 12 or to the base 20 and then decoupled at an impermanent connecting point (base 20 or vertical element 12) and slideably folded flat against the permanently attached element (base 20 or vertical element 12) for storage or transportation. The vertical coupler 28 thus can be any structure that joins the frame assembly 21 to the base 20, and there are many ways in which this can be accomplished. For instance, the vertical members 12 could have a lowermost coupler with a flange adapted to receive bolts that can then be bolted to the base 20, or the vertical coupler 28 could be affixed to the base 20 and the vertical members 12 are secured into the vertical coupler 28 with a spring push pin-hole coupling system, cotter pins, or other known suitable coupling systems.

In a preferred embodiment, the bench 30*d* according to the invention has a vertical support or bench leg 30*dd* attached to an underside of the bench 30*d* and that is either gravity supported on the base 20 or is removably affixed thereto using known means including the vertical couplers 28 used for attaching the vertical members 12 to the base 20. The bench 30*d* is further formed with bench couplers 30*da* on opposed sides of the underside of the bench 30*d* that mate with two side struts 14 on each side of the frame assembly 21 to span a width of the frame assembly 21 below the top and provide a built in seat in lieu of using a wheelchair, walker with a seat, etc.

The exercise station 100 specifically is designed for use, assembly and disassembly by frail users, typically elderly individuals with mobility issues and who often suffer from sarcopenia, as well as by young individuals who are mobility compromised such as those with multiple dystrophy. As such, the exercise station 100 has many safety features, including a bench back rest 30*ddd* for improved safety and stability for the user and to prevent inadvertent falls, and grab bars 32 secured to the vertical members 12 to help users, particularly those using canes, position themselves onto the bench 30*d* or a separate chair resting on the base 20. The cup holder 30*e* is another useful accessory optionally included in the exercise station 100 for convenience to the user, for holding beverage containers but also small items such as mobile devices, wallets, jewelry, a tv remote control, etc. during exercise. The cup holder 30*e* can also be reconfigured as shelf for holding a variety of lightweight items and is shown as an example of various useful accessory attachments that can be included as part of the exercise station 100.

Prior art exercises cages currently available at commercial gyms and for home use are made of heavy steel and rely on the mass of the cage itself to resist the user's application of force on the equipment. As the prior art exercise cages are designed to withstand use by fit individuals, who may exert many hundreds of pounds of explosive force on the prior art exercise cage during use as they tug, hang and otherwise exert force upon it from all angles, these cages are large, heavy and not designed to be easily moved or transported once set up. These cages are designed to be used by users standing inside as well as to a side of the cage, and many users will perform pull up exercises using the cage, where the cage must support their body weight. Consequently, the prior art cages are large, require significant space around the cage, and due to the materials needed for stability, tend to be very heavy. Each piece of the prior art exercise cage is relatively heavy as well, weighing several pounds.

While the best prior art full body workout cages are designed for commercial gym use, some are scaled down for home use as they are smaller and more affordable. Yet these exercise cages have many of the same issues as the commercial ones, as well as some new issues. The smaller and lighter the cage, the less stable it is and the fewer exercises that can be performed safely. These home gym cages are still made of heavy metal tubing and the inventor notes that all of prior art exercise cages, whether for commercial or home use, rely primarily on the mass of the metal frame for stability and to withstand pulling forces applied to the structure from a variety of angles by the resistance bands 30*c*. The inventor notes that these cages are of a completely different quality and character as compared to his invention. The inventor stresses that his exercise station 100 is designed specifically as a whole body workout for frail and mobility challenged individuals and thus is designed with their specific needs in mind.

While exercise cages allow for a full body workout, the cost, weight and room required has many home users of all mobility profiles preferring smaller, less expensive equipment. One such minimalistic home based exercise equipment routinely promoted as being ideal for use by mobility-restricted individuals and those with modest budgets are wall anchors designed for use with resistance bands. The wall anchors are permanently installed into wall joists and are formed with a ring to which resistance bands can be attached. Such anchors are relatively affordable but require wall space along wall joists, and tools for secure attachment thereto, as well as require removing furniture in front of the wall anchors. Spacing of wall joists means that the joist location determines the wall anchor location, which may be incompatible with the furniture in the room. As wall anchors are permanent installations, this arrangement can work well in a dedicated home gym space, but most people have multi-functional rooms and these permanent installations are often impractical in a room that doubles as a living room, with a couch, table, and other furniture and uses. For a mobility restricted user, the wall anchor could be positioned above an existing living room chair, but realistically, such chairs are designed for comfort and do not provide proper support and positioning conducive to exercise. Also, realistically, the comfortable recliner below the wall anchor must be moved to allow the user's wheelchair, walker or a dedicated bench or upright chair with a back to be positioned in front of the wall anchor for proper use.

Rarely is a single wall anchor used; many wall anchors at different heights are required to exercise all the body parts adequately, so the installation wall typically has many wall anchors, and to do exercises where the resistance bands are pulled across the body, the user's chair must also be repositioned so his or her back is now perpendicular to the wall where the anchor is located, which is why the idea of positioning one or more wall anchors above a large sofa or arm chair is neither realistic nor practical. The inventor notes that even able-bodied people, if required to move around furniture prior to and after exercise, are less likely to engage in exercise when faced with this hurdle and thus those with mobility issues are even less likely to exercise in these same circumstances. The exercise station 100 is a complete exercise system that can be easily assembled, disassembled, moved, etc. It has been shown that dedicated exercise areas encourage exercise.

The inventor notes that prior art exercise cages lack a built in base because they rely on the mass of the metal tubing as well as anti-tip leg designs that prevent the exercise cages from tipping. In contrast, the exercise station 100 however relies on the user's own body weight on the base 20 attached to the frame assembly 21 to prevent tipping. The exercise station 100 is sturdy but lightweight, made of PVC pipe and can be shipped or stored flat and is ideally available as a kit for self-assembly or disassembly. The kit may be just the base 20 and frame assembly 21, or may include the bench 30*dd*, bench back rest 30*ddd*, resistance bands 30*c*, bar accessory 30*a*, etc., in a same kit or as part of an additional accessory kit. The exercise station 100 can be stored and shipped flat in a box, with the frame assembly 21 in the representative embodiment shown in the FIGS. weighing approximately 45 pounds based on schedule 40 PVC pipe with a pipe total length of 45.271 feet and with a pipe diameter of 1.5 inches, and the base 20 approximately 4 feet by 8 feet weighing approximately 50 pounds when 0.5 inch thick plywood is used. Including the receiver fittings 22 24 26 26*a* and vertical couplers 28, the exercise station 100 is approximately 115-120 pounds, but each piece of the frame assembly 21 is no more than 1.6 pounds. The base 20 in the representative embodiment in the FIGS. is a heaviest single part of the exercise station 100 but can be configured in two or more pieces that can then be attached to one another during assembly to reduce the weight of each piece that must be handled by the user. The total weight of the exercise station 100 can be reduced by using different materials particularly for the base 20. It is an object of the invention to create a relatively lightweight exercise station, as compared to the prior art, which can be easily assembled, disassembled and transported (assembled or disassembled) and specifically the use of inexpensive, lightweight materials as compared to the prior art is a critical feature of the invention.

Unlike the prior art, the inventor's exercise station 100 has the flat base 20 to which the frame assembly 21 of the station 100 is attached. The flat base 20 allows the user to easily roll the wheelchair 34 or walker 36 into position within the exercise station 100, eliminating barriers to access. As the user sits on a chair or wheelchair 34 supported by the base 20, the user's own body weight further stabilizes the frame assembly 21 and thus allows for use of frame materials with less mass, and with equal or increased utility, moveability and cost as compared to the prior art. While hand weights could be used with the exercise station 100, the inventor notes that the exercise station 100 is specifically designed for use by frail individuals, and thus designed specifically for use with resistance bands 30*c*, providing better safety as compared to hand weights, and which are equally effective for resistance training without risk of injury to the user. The base 20 is further provided with a band anchor 30*f*, typically one or more metal loops or other structures attached to an uppers surface of the base 20 adapted to receive the resistance band 30*c* for performing leg exercises. The band anchor 30*f* could also be configured as a soft loop or structure to prevent tripping and can also be configured so as to be spring loaded, so that stepping on the band anchor 30*f* pushes it into the base 20 for storage or to eliminate tripping.

The inventor notes that some other attempts have been made to create an exercise station suited for mobility-impaired users. A prior art attempt to create a seated or lying down specific exercise station includes a single overhead bar, and elongated, anti-tip legs further affixed to a bed rail, for stability of the design and is described in U.S. Pat. No. 9,393,455 B2 to Salamon et al. The 1455 patent shows a gantry-style, single metal tube structure with a square cross section over a bed, with resistance bands attached to the overhead gantry section hanging down over a resting surface of the bed. To exercise the legs, the structure is rolled towards the legs and then repositioned towards the upper body for upper body work. Such repositioning of the structure requires the user to either be somewhat mobile or requires assistance by another more mobile person, two more common barriers to exercise. It is not conceivable how a person who is bed-bound can reposition the structure alone, without at least getting out of the bed.

To stabilize the device in Salamon, triangular or L-shaped supports are attached to the vertical members with some shown with wheels, to allow the device to be moved more easily. Salamon shows the overhead structure additionally affixed to the bed frame for further stabilization and support during use. The Salamon invention has been further shown positioned over living room arm chairs and recliners in advertising, and made from steel-forged aluminum square tubing, and the inventor notes some key differences between his exercise station 100 and the Salamon invention, particularly the chair variation: (a) Salamon is best adapted to only work on upper body strength by pulling downwards along the resistance bands from the overhead gantry; (b) Salamon relies primarily on its own mass for stability, the opposite of the inventor's exercise station 100 which relies on the pipe shape and the user's own body weight resting on the base 20 for stability; (c) there is no easy way to exercise legs when bands are affixed to an overhead structure, unlike the inventor's exercise station 100 which can affix resistance bands 30*c* to the base 20; and (d) the single overhead support in Salamon is unstable as compared to the three dimensional frame assembly 21 of the exercise station 100. In particular, exercising the user's legs using the structure in Salamon is difficult because pulling resistance bands attached overhead using the legs will pull on the overhead structure at an angle, creating a rotational force on the overhead structure when the user's legs apply angled downward force on the resistance bands. While Salamon claims that lightweight materials such as plastic can be used, this is only possible since Salamon teaches further affixing the structure to the bed frame as shown in FIG. 7, which would provide sufficient stabilization of the structure to prevent tipping if the overhead structure is made of lightweight plastic per the disclosure. The wheeled versions shown used with chairs are all made of metal thus using the mass of the tubing itself to prevent tipping when used, but none show the use of the base 20 and use of the user's own body weight resting on the base 20 for stability of the overhead structure.

The exercise station 100 specifically uses a lightweight frame assembly 21 coupled to the base 20 and is designed specifically for use by frail individuals. Frail individuals are easily injured by falls, and thus the exercise station 100 must be sufficiently stable to prevent falls, but lightweight enough to allow the user to assemble, disassemble and move the exercise station 100. The use of the base 20 coupled to the frame assembly 21 allows for substitution of lightweight materials relative to the prior art as the user's own body mass becomes an essential part of the exercise station 100. While some prior art exercise cages use structures that join lowermost portions of the cage together, they are not designed for the user to stand on as the cages are usually formed with three vertical walls and the joining structures, even if flattened, are narrow and positioned so as to join all three walls at their lowermost ends. Standing on those joining structures necessitates the user to stand very close to a back vertical wall, which limits the user's exercise space. Based on the position and size of these joining structures, it is clear they are designed to stabilize the cage walls rather than support the user's weight. Neither the base 20 coupled to the frame assembly 21 sized to support the user's body weight when in use, nor incorporation of the user's body weight as a necessary mass to stabilize the exercise station 100's frame assembly 21 are taught or suggested by the prior art. The inventor notes that current exercise cages have no attached base and are designed for strong, mobile people who will exert far more force on the cage than the users of the inventor's exercise station 100. The lack of a base in the prior art recognizes the mass of the prior art renders the base unnecessary. While some of the prior art cages advertise that they are optionally affixed to a room's floor, which would increase the stability of the overhead structure, this is highly undesirable since it can cause permanent damage to the floor and requires an understanding of the floor structure itself as bolting the overhead cage should be done into floor joists rather than just into superficial flooring materials.

The Salamon invention specifically does not rely on a base that supports and engages the user's full body weight and does not bolt into the floor but advertises how it can be easily repositioned. The inventor notes that in one embodiment of Salamon, the gantry-style frame is stabilized at floor level by lateral floor bars adjacent a floor surface, which are not flat on the floor and thus require the wheels of the wheelchair or walker to be positioned in front or behind these bars and necessitates that the wheels must travel over the bars. These lateral floor bars provide stability to the frame's vertical sides, but do not anchor the frame to the floor surface in any way; a user pulling down on a resistance band attached above the wheelchair will not dislodge the frame, but pulling on the band from one side only can cause the entire frame to shift, with movement of the frame limited by the wheelchair itself. The inventor notes that the frame taught by Salamon, used by a frail person, can be moved with such sudden force so as to knock the person sitting in the wheelchair or walker and potentially cause a fall. Another commercially available version of Salamon shows a flattened lateral support in lieu of bars, but again this is not the same as the base 20 of the exercise station 100 as the user's body weight is not positioned on the flattened support but rather is shown with the wheelchair wheels or chair legs on either side of the support. The lateral support is also not wide enough so that all four wheels of a wheelchair can rest on the support at a same time. The flattened lateral support solves the issue of inaccessibility to the use position beneath the upper bar by the floor bars creating obstacles to wheelchairs and walkers, but it is still not designed to use the user's own body weight to stabilize the gantry structure. If a pair of wheels rest on the lateral support, the wheelchair is now tilted, creating some additional safety concerns. While the user may have his or her feet positioned on a lateral bar, little of the user's body weight is engaged and exercising the legs would necessitate lifting the feet off the bar and remove the user's body weight on the bar for stabilization of the frame assembly. It should be noted that Salamon always shows vertical leg supports with anti-tip or anti-rotation designs, which are unnecessary in the inventor's exercise station 100 due to the use of the base 20. Salamon's device is thus of limited use and is potentially dangerous. The inventor notes that Salamon is not well suited to any exercise that involves pulling bands attached to the vertical members supporting the overhead bar, or even pulling the bands attached to the overhead gantry forwards without having the mass of the equipment materials being substantial. The cost of the Salamon invention is also prohibitive to most, retailing for approximately $3000 USD as of 2025. The original embodiment for Salamon was as a bed exercise device assuming the user would be bedridden and thus have help. Salamon has tried to repurpose it as a home exercise system for use and advertised his invention with recliners and other living room furniture, but it fails to address several of the key barriers to exercise by frail users: cost, stability, ease of unassisted use, and the ability to easily move, assemble and disassemble the invention when needed. The inventor notes too that while the patent shows the Salamon invention also attached to the bed frame, the retail version eliminates this attachment so it can freely move beneath the bed. While some beds have central supports beneath the mattress portion, most are open below the four corner bed supports and the inventor does not see anything suggesting that use of Salamon with a bed as shown would require the invention to be positioned underneath a central bed support so as to use a prone user's body weight to stabilize the Salamon invention.

It is to be understood that the above-described arrangements are only illustrative of the application of the principles of the present invention. Numerous modifications and alternative arrangements may be devised by those skilled in the art without departing from the scope of the present invention. The base 20 may have a chamfered or tapered front and back edges to eliminate base edges that may catch a wheel or present a tripping hazard and may be foldably designed with one or more hinges to allow the base to be folded and stored or shipped flat. Alternatively, the base 20 may be configured in two or more separate pieces that are joined prior to installation of the frame assembly 21 for easier storage and transportation. The inventor notes that his exercise station 100 allows the user to remain seated in a same place while performing full body exercises, rather than requiring the user to reposition his or her body within the exercise station, which for a frail or mobility-impaired individual increases the barrier to exercise. Maintaining a same position throughout the exercises also allows a television or other screen to be positioned in front of the exercise station, where the user can watch an instructional exercise video and mimic exercises shown on the screen. The cup holder **30*e*** allows the user to easily control the video as needed.

This invention was inspired by the inventor's late wife, whose mobility impairment restricted her once active lifestyle, exacerbating her sarcopenia, and ultimately taking a toll on her health. He looked at many different solutions but all presented barriers to exercise as previously described. His devotion to Bette and his creative, problem solving mind led to the creation of the exercise station 100, which he believes can help many frail and mobility-impaired individuals of every income level and adaptable to a variety of living spaces. Muscle is the organ of life, and the exercise station 100 is designed specifically to address the needs of people like his dearest Bette. This exercise station 100 is a testament to the inventor's creativity and desire to improve the quality of all our lives as we age, as well as a tribute to Bette, whose life and love continues to fuel and inspire him.

What is claimed is:

1. An exercise station adapted for use by a mobility impaired person using a cane, wheelchair or walker and adapted for use with a plurality of resistance bands removably attached thereto, the exercise station comprising:

a frame assembly having a plurality of pipes, each pipe of the plurality of pipes having a predetermined length and pipe diameter, and pipe fittings, each pipe fitting having a predetermined configuration and fitting diameter adapted to be pressure fitted into the pipes so as to form a rectangular-shaped cage having a front frame, a back frame, a top side, a left side, and a right side;

wherein the top side has at least two horizontal pipes in parallel, spaced apart relationship;

a base removably coupled to the frame assembly, the base sized and shaped so as to cover at least an entire area below the top of the frame assembly and having at least one chamfered edge;

a band anchor fixed to the base adapted to receive a resistance band; and at least two vertical couplers fastened to the frame assembly and removably fastened to the base;

wherein the plurality of pipes include horizontal struts joining the front and back frames, and adapted to support an accessory bench;

wherein the frame assembly is made of pvc pipe;

wherein the frame assembly, the base, and the at least two vertical couplers are removably secured to form the exercise station, whereby the exercise station can be assembled and disassembled without tools; and wherein the frame assembly weighs no more than 70 pounds.

2. The exercise station in claim 1, wherein the frame assembly is made of Schedule 40 plastic pipe.

3. The exercise station in claim 1, wherein the pipes of the frame assembly have a pipe diameter of at least 1 inch.

4. The exercise station in claim 1, wherein at least one of the at least two vertical couplers is an L-shaped bracket.

5. The exercise station in claim 4, wherein the L-shaped bracket is a folding bracket permanently or removably coupled to either the vertical member or to the base.

6. The exercise station in claim 1, wherein at least one of the at least two vertical couplers is removably fastened to the frame assembly using one or more straps.

7. The exercise station in claim 1, wherein the fittings further include T-shaped, Y-shaped, and elbow shaped pressure fittings adapted to receive the pipes.

8. The exercise station in claim 1, wherein the base is further comprised of two parts hingeably connected.

9. The exercise station in claim 1, wherein the band anchor is a metal loop.

10. The exercise station in claim 1, further comprising a pair of hand grab bars attached to opposed sides of the front frame.

11. The exercise station in claim 1, provided as a kit, and further comprising a removable bench having a pipe coupler on a bench underside whereby the bench is pressure fitted to the left side and the right side of the frame assembly, and further comprising at least one vertical support below a center of the bench with an upper end attached to the bench underside and the opposite end engaging the base.

12. The exercise station in claim 1, further comprising an accessory kit comprising a removable bench, a bench back rest, and a plurality of resistance bands.

* * * * *